US005159805A

United States Patent [19]

Wernli

[11] Patent Number: 5,159,805

[45] Date of Patent: Nov. 3, 1992

[54] GUIDE ARRANGEMENT FOR PEG TRAYS ON A RING SPINNING MACHINE

[75] Inventor: Jorg Wernli, Winterthur, Switzerland

[73] Assignee: Rieter Machine Works, Ltd., Winterthur, Switzerland

[21] Appl. No.: 679,954

[22] Filed: Apr. 3, 1991

[30] Foreign Application Priority Data

Apr. 3, 1990 [DE] Fed. Rep. of Germany ..... 4010730

[51] Int. Cl.[5] ..... D01H 9/10; B65H 54/02

[52] U.S. Cl. ..... 57/281; 57/90; 242/35.5 A; 198/733

[58] Field of Search ..... 57/281, 90; 242/35, 242/5 A; 198/730, 731, 733, 735

[56] References Cited

U.S. PATENT DOCUMENTS

| | | | |
|---|---|---|---|
| 1,297,569 | 3/1919 | Johnson | 198/730 X |
| 4,432,198 | 2/1984 | D'Agnolo | 57/276 |
| 4,655,665 | 4/1987 | Lattion | 242/35.5 A X |
| 4,813,222 | 3/1989 | Fukuda et al. | 57/281 X |
| 4,875,572 | 10/1989 | Kiriake | 242/35.5 A X |
| 4,964,269 | 10/1990 | Dindelmann | 57/281 |

FOREIGN PATENT DOCUMENTS

| | | |
|---|---|---|
| 1760689 | 2/1972 | Fed. Rep. of Germany . |
| 3712027 | 10/1987 | Fed. Rep. of Germany . |
| 3812342 | 10/1989 | Fed. Rep. of Germany . |
| 57-161134 | 10/1981 | Japan . |
| 62-191524 | 8/1987 | Japan . |
| 1168638 | 10/1969 | United Kingdom . |

*Primary Examiner*—Daniel P. Stodola
*Assistant Examiner*—Michael Mansen
*Attorney, Agent, or Firm*—Francis C. Hand

[57] ABSTRACT

A ring spinning machine is provided with a carrier rail extending along each row of spinning stations for slidably guiding peg trays. A guide rail is secured to the carrier rail for receiving connecting pieces in snap-fitted relation which serve to move the peg trays along the carrier rail. The connecting pieces are secured to a vertically disposed conveyor belt so that the conveyor belt is guided by the connecting pieces along the spinning stations.

20 Claims, 4 Drawing Sheets

GUIDE ARRANGEMENT FOR PEG TRAYS ON A RING SPINNING MACHINE

This invention relates to a ring spinning machine. More particularly, this invention relates to a guide arrangement for peg trays on a ring spinning machine.

Heretofore, ring spinning machines have been provided with a variety of transport devices for transporting empty tubes to spinning stations of the machine and for removing full tubes (cops). For example, British patent 1,168,638 describes a spinning machine in which two pegs are fastened directly onto an endless conveyor belt which can be moved by the spinning stations of the ring spinning machine. In this case, the endless conveyor is generally formed as a steel belt with as little distortion as possible, so that the predetermined spacing of the tube pegs, which must correspond exactly with the spacing of the spinning positions, remains unaltered, even with long periods of operation of the machine. The tube pegs have also been arranged at half the spacing of the spinning positions in order to be able to pick deliver an empty tube and pick up a full tube (cop) at the same time when doffing from the assigned spinning position. It is also possible to space the tube pegs only at the spacing of the spinning positions, whereby with tubes changes, another tube peg must then be provided at every spinning position in order to receive one of the tubes to be changed for a short time, such as described in U.S. Pat. No. 3,905,184.

Furthermore, U.S. Pat. No. 4,667,807 describes the use of an endless conveyor on each side of a ring spinning machine, with tube pegs fitted on both sides of the belt on each endless conveyor, so that during a change of a full tube (cop) for an empty tube, the full tube can first be put on an empty tube peg, whilst subsequently, from the empty tube peg assigned to the same spinning position, an empty tube is removed from the other side of the belt and placed on the spindle of the spinning position. Also, with this known ring spinning machine, the tube pegs are connected directly with the endless conveyor via angle brackets.

The only problem with the aforementioned ring spinning machine is whether the carrier pegs form a fixed component of the endless conveyor, which is desirable, because the carrier pegs in the tube changing position of the endless conveyor must be aligned exactly with their individually assigned spinning position. For these reasons the full tubes (cops) on the end of the last spinning position must be taken off by carrier pegs and then transferred to the peg trays of a winding machine, for instance. Conversely, the empty cops conveyed from the winding machine must be transferred at the start of the first spinning position group by means of special grasping and lifting devices from the peg trays of the winding machine on to the carrier pegs.

Published Japanese patent application 57-161 134 shows that the peg trays used with a winding machine can also be used as a conveying means for empty tubes or as a means of removal of full tubes for an associated spinning machine. In this case, the peg trays, which generally consists of a circular disc and a vertically arranged central peg, are slid in a guide rail round the ring spinning machine, whereby the diameter, in particular the length of a peg tray, is slightly less than the spacing between two neighboring spinning positions. The individual peg trays are in contact with each other and are moved forwards through the force applied to one or more of the peg trays, whereby the pushing force is transferred at least in part through the direct contact of the peg trays. A conveying device for peg trays of this type is also known from published U.S. Pat. No. 4,667,807.

A disadvantage of the ring spinning machine according to JP-OS 57-161 134 is that the tube pegs are not exactly in alignment with the spinning positions, when a group of peg trays with empty tubes is slid in front of the assigned spinning positions on one side of the machine. For this reason, before the tube change can be undertaken, a rake is slid between the peg trays at right angles to the longitudinal axis of the spinning machine so that the spacing between the neighboring tube pegs is exactly coordinated with the spacing between the neighboring spinning positions.

With a similar tube transport device (German OS 37 12 027), a reciprocating rail extending along the spinning position or a similar device, works in conjunction with a slidable peg tray so that the peg tray is slid in steps up to the assigned spinning position. So that the spinning trays are exactly aligned with the assigned spinning positions, they must o either have a length which is exactly the same as the spacing of the spinning positions, or swivelling lockout elements of a ratchet type are provided on the rail which are located exactly at the spacing of the spinning positions, so that the closing elements also ensure exact alignment with the assigned spinning position when the holding trays are not in contact with each other.

The provision of a special alignment rake for the peg trays (JP-OS 62-191 524) as well as the assignment of a closing ratchet for each peg tray (DE-OS 37 12 027) require a considerable amount of space. Furthermore, the known arrangements are susceptible to troubles and require considerable maintenance.

It has also been known to provide connection pieces on a conveyor belt for moving peg trays along the spinning stations of a ring spinning machine. However, a problem with spinning machines of this type, exists in the satisfactory guidance of the conveyor, preferably formed as a steel belt with as little ductility as possible, but which is however flexible, along the spinning positions. Thus, attention must be given to ensure that the connection pieces arranged on the conveyor belt are positioned exactly in relation to the spinning positions, so that the peg trays or tubes carried by the connection pieces can be brought into exact alignment with the spinning positions.

To this end, it has already been proposed that the connection pieces be guided on a guide rail fixed to the machine in the longitudinal direction of the spinning machine in such a way that the conveyor belt fastened to the connection pieces is itself held by the connection pieces in the desired vertical and horizontal position. In this way tilting, fluttering or sagging of the conveyor belt is prevented without the necessity for the provision of a special means for guiding and stopping the belt.

A problem with machines of this type exists in that the guide rails and the connection pieces should be arranged to save as much space as possible, without detracting from the exact positioning of the peg trays on the spinning position, which is also important for the guiding of the connection pieces on the guide rails.

The object of the invention lies in the development of a spinning machine of the type mentioned at the outset which ensures exact guidance or holding of the peg trays and the conveyor belt, in spite of the space saving arrangement of the guide rails.

It is another object of the invention to provide a simplified arrangement for conveying peg trays along the spinning stations of the ring spinning machine. Briefly, the invention is directed to a ring spinning machine having at least one row of spinning stations, a vertically disposed endless conveyor belt for moving along the row of spinning stations, a carrier rail extending along the row of spinning stations for slidably guiding peg trays thereon and a guide rail secured to the carrier rail with guide means in a vertical side thereof.

In addition, a plurality of connection pieces are secured to the conveyor belt in a spaced apart relation corresponding to the spaced relation of the spinning stations for moving the peg trays along the carrier rail. Each connection piece is also provided with a projecting finger for moving a respective peg tray along the carrier rail as well as guide means on a vertical side thereof in sliding engagement with the guide means of the guide rail.

In one embodiment, the guide means of the guide rail includes a pair of vertically spaced projections while the guide means on each connection piece includes a pair of resilient vertically spaced tongues which are snap fitted over the projections. In another embodiment, the guide means on the guide rail may be in the form of a recess while the guide means on each connection piece includes a projection received in the recess of the guide rail in sliding relation.

In accordance with the invention, the guide projections and guide recesses matingly engage with each other from the front or back and, in no case, from underneath. Advantageously, the connection pieces serve to positively guide the conveyor belt along the row of spinning stations. In this respect, the conveyor belt need only be disposed about guide pulleys or rollers disposed at the opposite ends of the row of spinning stations.

In this way, it is possible to arrange a functional optimization of an efficient horizontal guidance of the conveyor belt, without an excessive space requirement. An important additional advantage of the arrangement lies in that the guide projections, with corresponding dimensioning, can also be fitted in the guide recesses from the side. Finally, in this way, it is also possible to transmit the guiding forces between guide rails, connection pieces and conveyor belt by the shortest and most direct route without a large deviation of power.

The vertical spacing of the projections on the guide rail and the mating relation of the tongues of each connection piece provide for a compact arrangement for the connection of the connecting pieces to the guide rail and, thus, lead to space savings. In addition, the projections may be rounded while each tongue in curved in order to mate with a respective projection along a curved surface. In this case, the axes of the curves extend in the longitudinal direction of the spinning machine. This construction avoids tilting or deviation of the conveyor belt in the horizontal direction. Further, any movement of the conveyor belt and of the connection pieces except in the conveying direction can be effectively avoided without any excessive requirement for space for the guiding surfaces.

In the embodiment where the projections are located on the guide rail and the tongues on the connecting pieces, each connecting piece is also provided with a recess between the tongues into which the projections of the guide rail may project. In such an embodiment, channels shaped guide surfaces on the spinning machine itself can be avoided in which dust, dirt or fiber fly might otherwise accumulate.

In the embodiment using resilient tongues which are snap-fitted over the projections, the projections of the guide rail can be located on the rear end of an appropriate longitudinal profile while each connecting piece is located between the guide rail and the conveyor belt. Further, the assembly and disassembly of the connection pieces can be facilitated through the snap fitting of the connection pieces onto the guide rail. In this respect, the mounting of the connection pieces can be effected on any desired place on the guide rail.

A particular space saving accommodation of the guide rail is effected by disposing the guide rail underneath the carrier rail.

In order to achieve a particularly favorable power transmission from the connection pieces and, conversely, each connection piece has a contact surface extending vertically over the height of the conveyor belt. In this way, complete surface contact, that is, a large surface contact, exists between the conveyor belt and the connection pieces, through which bending or slipping of the conveyor belt in the area of the connection pieces can be avoided. Therewith, the actual fastening is only punctiform, preferably in the middle, so that the passage round the guide rollers is not impeded.

Furthermore, the guide rail may be arranged substantially at the same height as the conveyor belt for a space saving fitting and power transmission over the shortest route.

In order to avoid a lateral guiding means for the peg trays, each connection piece is provided with a resiliently mounted support element which extends in parallel to the projecting finger of the connection piece for resiliently grasping a peg tray therebetween. In this way, each connection piece can be fastened independently of the others in an exact place on the conveyor belt. Thus, the assignment of neighboring connection pieces for the purpose of holding a peg tray therebetween does not need to be considered. The construction is particularly of advantage for securely holding the peg trays for the negotiation of curves in the area of the guide rollers for the conveyor belt.

With the use of an additional resiliently mounted support element, the carrier rail may be flat and may be disposed at an angle of from 5° to 15° relative to a horizontal plane and inclined in a direction away from the conveyor belt. In this arrangement, the accumulation of dirt or fiber fly on a carrier rail is effectively avoided.

In one advantageous construction, the carrier rail and guide rail can be of integral one-piece construction. Further, the machine frame may be provided with a recess for receiving the guide rail. In this case, the machine frame would have a guide strip engaging over a rear projection of the guide rail while a clamping strip is secured to the machine frame over a front projection of the guide rail. This embodiment is particularly expedient for assembly or disassembly.

These and other objects and advantages of the invention will become more apparent from the following detailed description taken in conjunction with the accompanying drawings wherein:

FIG. 1 schematically illustrates a top view of a ring spinning machine adjacent to a winding machine and having a conveying arrangement in accordance with the invention;

Figure 1:
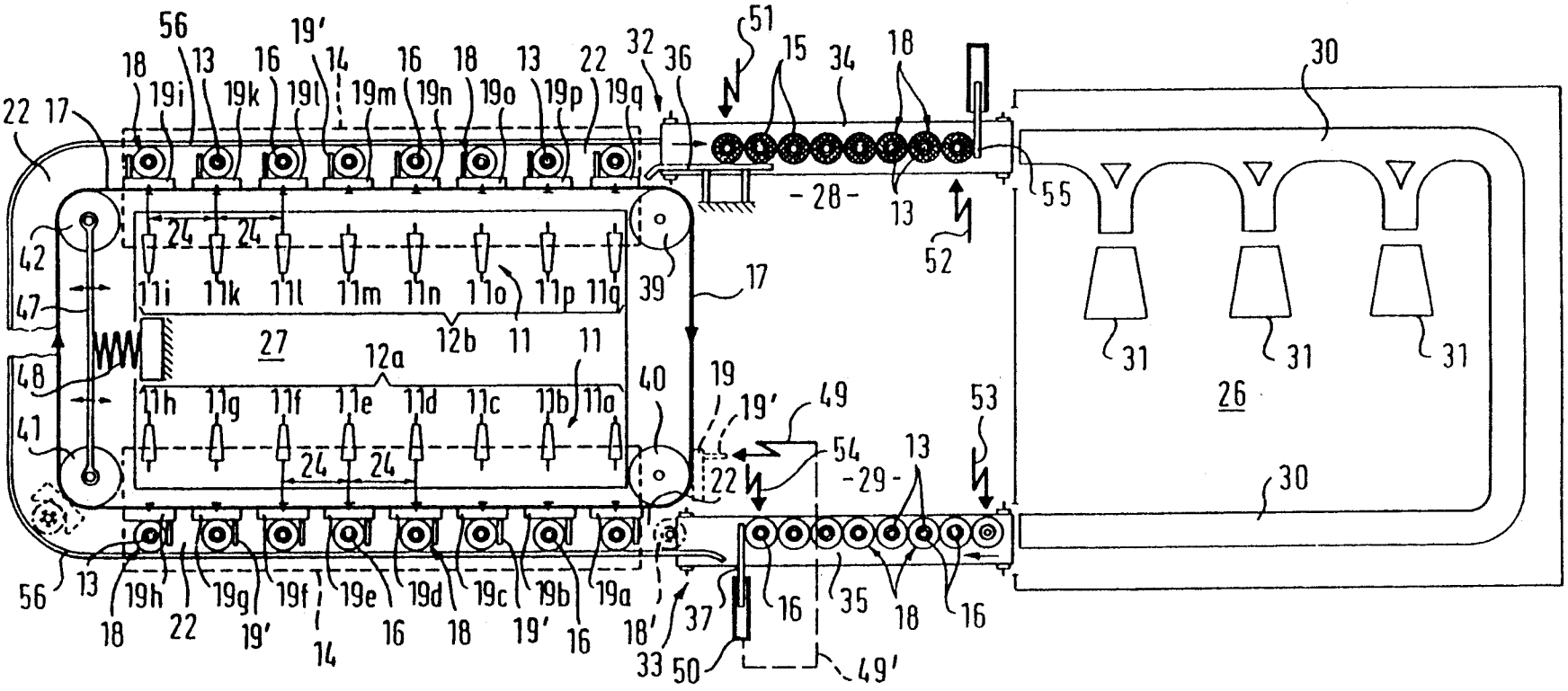

Referring to FIG. 1 the ring spinning machine 27 is located adjacent to a winding machine 26 in a conventional manner. Each machine is of generally conventional construction and need not be described in detail.

The ring spinning machine 27 is provided with two rows 12*a*, 12*b* of spaced apart spinning stations 11*a*–11*h*; 11*i*–11*q* on opposite sides of the machine. As indicated, the spinning stations are spaced apart at a predetermined spacing 24. Of note, the number of spinning stations 11 is illustrated at a reduced number for the sake of clarity.

As illustrated, a vertically disposed endless conveyor belt 17 is disposed about four guide pulleys or rollers 39, 40, 41, 42 in order to move along each row 12*a*, 12*b* of spinning stations. The conveyor belt 17 may be of steel. Further, the guide rollers or pulleys 41, 42 are connected to each other by a spreader bar 47 which is biased by a spring or tension device 48 relative to the machine frame so as to move in the direction indicated by the double arrow longitudinally of the machine frame. The tension device 48 serves to impart an initial tensile stress on the conveyor belt 17.

As indicated, a plurality of connection pieces 19*a*–19*h*; 19*i*–19*q* are secured to the conveyor belt 17 in spaced apart relation corresponding to the spaced relation of the spinning stations for moving peg trays 18 along the spinning stations. Each connection piece 19 also has a projecting finger 19' for moving a respective peg tray 18.

A carrier rail 22 also extends along the rows 12*a*, 12*b* of spinning stations for slidably guiding the peg trays 18 thereon. As indicated, the carrier rail 22 is of generally U-shaped construction in order to guide the peg trays 18 along each longitudinal side of the ring spinning machine 27 as well as along one transverse side of the ring spinning machine 27. A guide rail 56 is also disposed on and along the carrier rail 22 in order to prevent the peg trays 18 from moving off the guide rail 22.

Figure 2:
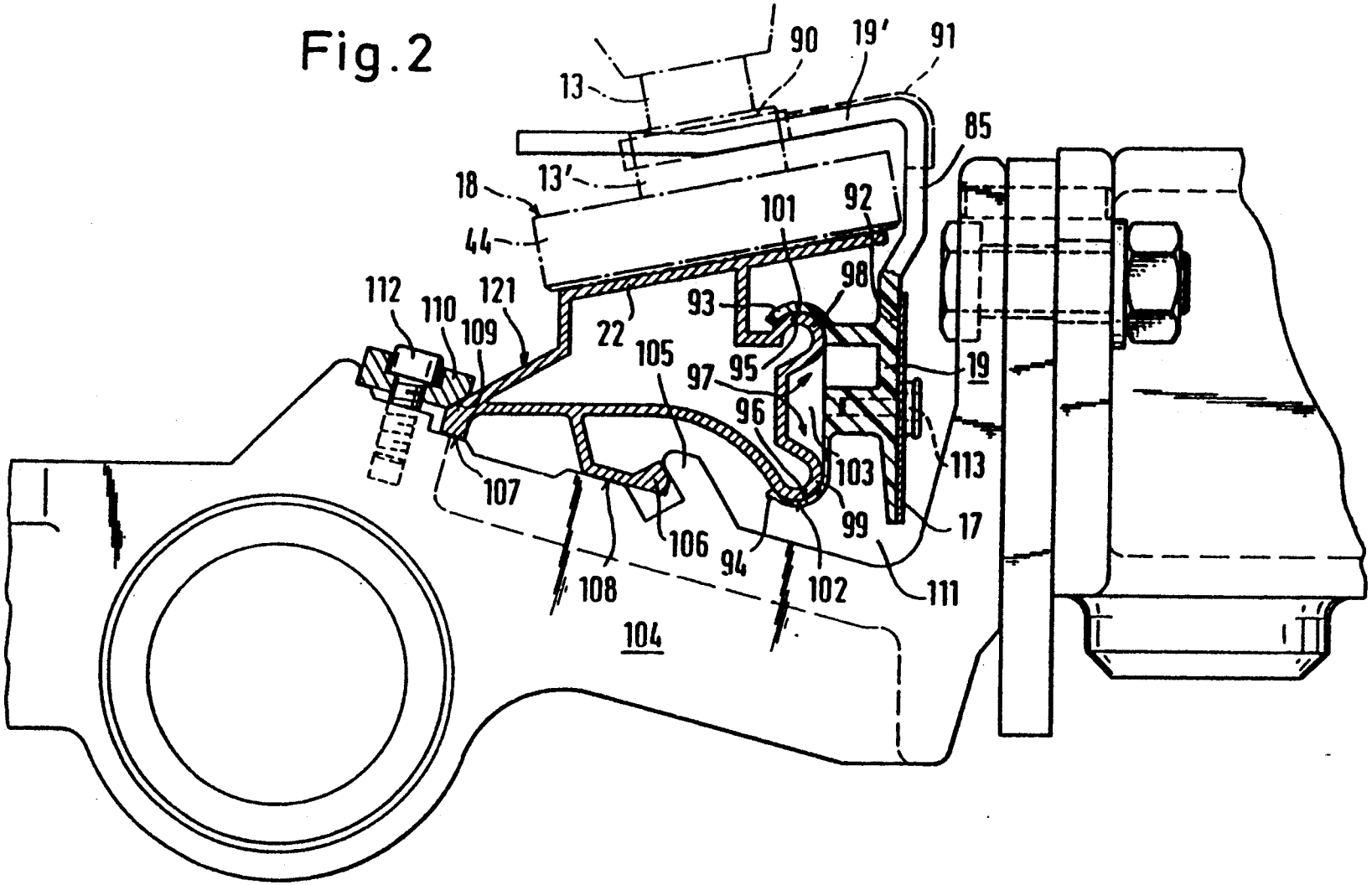
FIG. 2 illustrates an enlarged cross-sectional view of a carrier rail, guide rail, connecting piece and belt arranged in accordance with the invention.

Referring to FIG. 2, the carrier rail 22 is flat and is inclined downwardly in a direction away from the belt 17 on an angle of from 5° to 15° (preferably 10°) relative to a horizontal plane.

As indicated in FIG. 2, each peg tray 18 has a circular disc-shaped sliding element 44, a vertically disposed tube peg 13 and a widened foot 13' between the peg 13 and sliding element 44. Each peg tray 18 is preferably made in one piece from plastic and is contacted from behind by a projecting finger 19° of a connection piece 19. As indicated in FIG. 1, each projecting finger 19, projects perpendicularly across the carrier rail 22.

The ring spinning machine is provided with a pair of tube change devices 14, shown in dashed line, each of which can be formed with conventional doffers and serve to remove full tubes (cops) and to place empty tubes 16 on the spindles of the spinning stations 11.

Further, at a suitable place, for instance between the guide pulleys 39, 40, the machine 27 can be provided with a cleaning station having blowing or suction nozzles and/or brushes in order to clean the connection pieces 19 and the conveyor belt 17 of fiber fly and the like. Further, a cleaning element in the form of cleaning disc, for instance, can be fastened on any suitable place of the endless conveyor 17 which is not occupied by connection piece 19 to travel around on the carrier rail 22 with the belt 17.

As shown, a pair of buffer stretches 28, 29, each of which is formed by a conveyor belt 34, 35, respectively, is provided in alignment with the respective row of spinning stations 11 to communicate the ring spinning machine 27 with the winding machine 26. As schematically illustrated, the winding machine 26 is provided with guide rails 30 and winding positions 31, for example being of a number slightly less than the number of spinning positions 11 of the spinning machine 27.

The conveyor 34 is aligned with the carrier rail 22 so as to receive full tubes 15. In this respect, a diverter rail 36 is provided with the conveyor 34 so as to guide a full tube 15 from the end of the carrier rail 22 onto the conveyor 34. This diverter rail 36 is positioned so as to direct a peg tray 18 onto the conveyor 34 without interfering with the connecting piece 19 and projecting finger 19'. Thus, the diverter rail 36 serves to separate the peg tray 18 from the connection piece 19 for movement onto the conveyor belt 34. A light barrier 51 is also provided at the rear end of the conveyor 34 to determine the presence or absence of a peg tray 18 thereat. In addition, a mechanical stop device 55 which can be moved in and out is provided on the front end of the conveyor belt 34. This stop device 55 is retracted for a short period of time in order to permit the passage of a predetermined number of full tubes 15 to the winding machine 26. In this respect, a further light barrier 52 is provided adjacent to the stop device 55 to control the operation of the stop device 55 with respect to the number of tubes 15 to be delivered to the winding machine 26.

The conveyor belt 35 extends from the guide rail 30 of the winding machine 26 to the carrier rail 22 of the spinning machine 27 in order to convey empty tubes 16 therebetween. As indicated, the conveyor belt 35 cooperates with a stop device 37 which is disposed at a forward end of the conveyor belt 35. In addition, a driving device 50 which is controlled via a light barrier 49 over a line 49' serves to open and close the stop device 37 so as to release a peg tray 18 for movement to the ring spinning machine 27 on an individual basis. In this respect, the stop device is retracted for a short period of time in order to permit only one peg tray to advance. As indicated, the light barrier 49 serves to determine the presence or absence of a peg tray on a connecting piece 19 moving into position adjacent the guide pulley 40, so as to control the operation of the driving device 50 and conveyor belt 35. Additional light barriers 53, 54 are also provided at the rear and forward ends of the conveyor belt 35 to detect the presence or absence of peg trays 18 thereat.

The conveyors 34, 35 are controlled for a short period of time or continuously driven during a tube change process.

Once the foremost peg tray 18 has been released by the stop device 37, the peg tray is advanced onto the carrier rail 22 and is engaged by the projecting finger 19' of a connecting piece 19 and positively guided along the guide rail 22.

Referring to FIG. 1, during operation, the winding machine 26 and ring spinning machine 27 cooperate in the manner as follows.

In the position represented in FIG. 1, a peg tray 18 loaded with an empty tube 16 is found in front of every spinning position 11. As soon as the tubes arranged on the spindles of the spinning positions 11 are fully wound with yarn, the empty tubes 16 on the individual peg trays 18 are lifted by the tube changing device 14 from the tube pegs 13 and the full tubes (cops) 15 on the spindles of the spinning position are lifted and exchanged for the empty tubes 16. The full tubes 15 are thereby assigned to the carrier peg 13 of the appropriate peg tray 18. The intermediate pegs required for the tube change are not represented in FIG. 1 for the sake of clarity.

As soon as the exchange of full tubes 15 and empty tubes 16 is completed, the spinning operation on the ring spinning machine 27 is resumed and the endless conveyor 17 is put into operation in the direction of the arrow, whereupon the full tubes 15 are successively passed by the diverter 36 on to the conveyor belt 34 of the buffer stretch 28. On the other end of the conveyor belt 34, the winding machine 26 calls for the required number of full tubes 18 in order to produce packages at the winding positions 31 of the final size on the winding machine 26.

From the guide rails 30 of the winding machine 26, the wound off empty tubes with the carrying peg trays 18 are delivered to the conveyor belt 35 of the buffer stretch 29, whereby they are conveyed successively up to the stop device 37. In this way, a row of directly neighboring peg trays 18 exists on the conveyor belt, which represent a reserve for delivery to the endless conveyor 17.

As soon as a connection piece 19, with the connection piece finger 19', as represented in FIG. 1 by the dashed line, comes into position directly in front of the guide pulley 40, the light barrier 49 and the driving device 50 are activated so that the stop device 37 is retracted for a short period of time. As a result, the conveyor belt 35 moves the foremost peg tray up to the position 18' shown by a dashed line FIG. 1. The peg tray 18 is now in position on the stationary carrier rail 22 and waits for the connection piece finger 19' of the connection piece 19 to engage and convey the tray 18 along the carrier rail 22 to the assigned spinning position of the spinning positions 11*a* to 11*h* or 11*i* to 11*q*.

As the connection pieces 19 on the conveyor belt 17 in the change position represented in FIG. 1 are positioned exactly in relation to the individual spinning positions 11, the peg trays 18 carried along, and therewith the carrier pegs 13, are also aligned exactly to the individual spinning positions 11.

Referring to FIG. 2, a guide rail 121 is secured to the carrier rail 22, for example being integral therewith to form a one-piece construction. This guide rail 121 is in the form of a hollow profile which extends longitudinally along and with the guide rail 22 about the sides of the ring spinning machine.

The guide rail 121 has guide means in the form of a projection 97 on a vertical side facing the conveyor belt 17. As indicated, the projection 97, in turn, is formed by a pair of vertically spaced projections 95, 96 in the form of bourrelets 98, 99 to form curved guide surfaces. Each connecting piece 19 which is secured as by a rivet or other fastening member 113 to the conveyor belt 17 has mating guide means in the form of a recess 103 on a vertical side. As indicated, the recess 103 is defined by a pair of resilient, vertically spaced tongues 93, 94 which, in turn, are snap-fitted over the projections 95, 96 of the guide rail 121. As indicated, each tongue 93, 94 is curved to have a guide surface 101, 102 in mating engagement with the curved surface of a projection 95, 96 of the guide rail. Preferably, the carrier 19 is made of plastic.

As indicated in FIG. 2, the connecting piece 19 has a vertically disposed supporting arm 85 from which the projecting finger 19' extends. In this respect, the projecting finger 19' has a part which is in parallel to the carrier rail 22 and an end part which is disposed in a horizontal plane. The projecting finger 19' is positioned above the carrier rail 22 so as to contact the peg tray 18 in the vicinity of the foot 13'.

Figure 5:
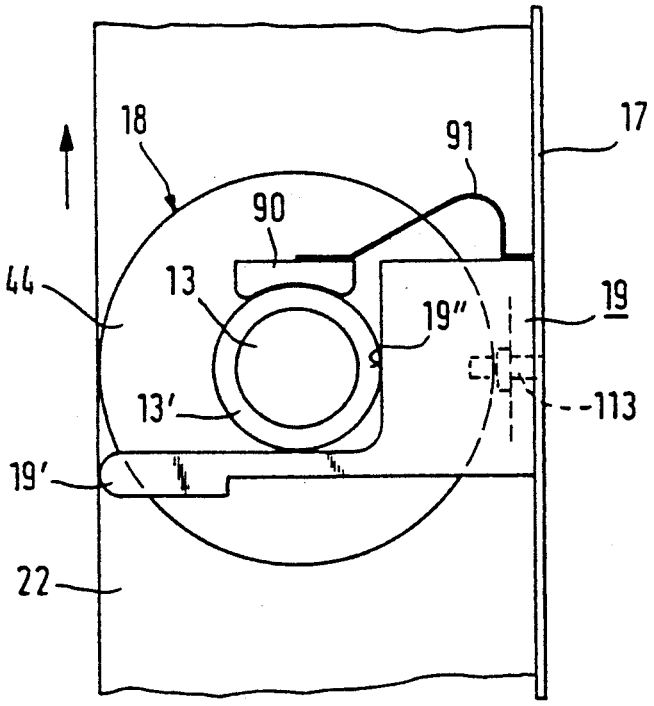
FIG. 5 illustrates a top view of a connecting piece having a resiliently mounted support element in accordance with the invention.

Referring to FIGS. 2 and 5, the connecting piece 19 may also be provided with an auxiliary support element 90 which is resiliently mounted on the supporting arm 85 or directly on the connection piece 19 As indicated in FIG. 5, the support element 90 extends in parallel to the projecting finger 19' and has a curved surface thereon for resiliently engaging a peg tray 18 between the support element 90 and the projecting finger 19'. In this way, a peg tray 18 is guided laterally so that the lateral guide 56 shown in FIG. 1 is not required.

Referring to FIG. 2, the guide rail 121 and conveyor belt 17 are located within a recess 111 of a frame 104 of the ring spinning machine. In addition, the guide rail 121 carries a stop projection 106 which is received under a guide strip 105 of the machine frame 104 as well as a front projection 109 which is received under a clamping strip 110 which is secured to the machine frame 104 by one or more bolts 112. Also, the guide rail 121 has a pair of surfaces 107, 108 which engage against suitable flat surfaces of the machine frame 104. In this way, the guide rail 121 can be fixed in an exactly defined position relative to the machine frame 104.

As illustrated in FIG. 2, the connection piece 19 is aligned exactly and without tilting in relation to the machine frame 104 and can only move in its defined sliding position in the longitudinal direction of the machine, which is vertical to the plane of the drawing of FIG. 2. With a movement of the conveyor belt 17, which is itself not guided except over the guide pulleys, the connection piece 19 is correspondingly pushed vertically to the plane of the drawing of FIG. 2, and thereby slides in the longitudinal direction of the machine on the guide rail 121 Thereby, the connection piece finger 19' carries the peg tray 18 which slides along the carrier rail 22. Slipping from the level guide rails 22 is prevented by the support element 90.

By virtue of the guiding of the connection piece 19 on the guide rail 121, the conveyor belt 17 itself is also correspondingly guided, so that no special means of active guiding is required to be in contact with the belt 17.

Advantageously, the guide projection 97 with the guide surfaces 95, 96 is located underneath the carrier rail 22 next to the fixing points 105, 106, 107, 109. Furthermore, it is expedient that the guide projection 97 is approximately the same height as the height of the conveyor belt 17, so that in between there is only a comparatively thin block of material of the connection piece 19.

A further advantage lies in that the conveyor belt 17 as well as the surfaces 95, 96, 101, 102 are protected from dirt and fiber fly and are not affected by the travelling blower.

Figure 3:
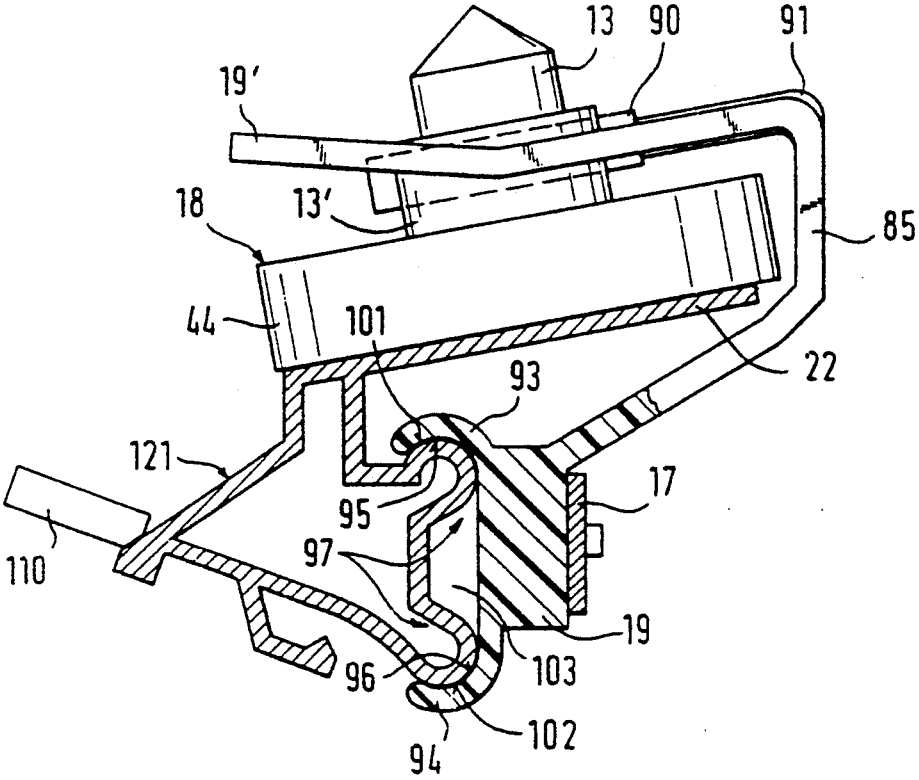
FIG. 3 illustrates a cross-sectional view of a modified embodiment of a connecting piece and guide rail in accordance With the invention.

Referring to FIG. 3, wherein like reference characters indicate like parts as above, the conveyor belt 17 is located underneath the carrier rail 22 so that the belt 17 is in a vertical plane passing through a central portion of the carrier rail 22. In this respect, the guide projection 97 or the guide recess 103 is located as vertically as possible below the point of application of the connection piece finger 19' on the peg tray 18. Consequently, horizontal moments are avoided and, through this, the belt 17 remains flat and the friction between the guide surfaces 95, 96 as well as the opposing surfaces 101, 102 is minimal.

Figure 4:
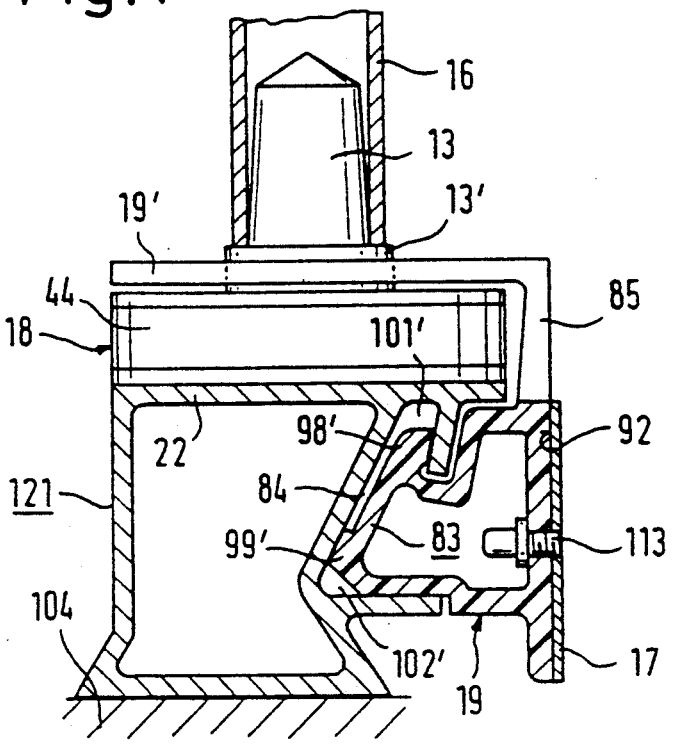
FIG. 4 illustrates a cross-sectional view of a further modified arrangement of a connecting piece and guide rail in accordance with the invention.

Referring to FIGS. 4 and 5, wherein like characters indicate like parts as above, the carrier rail 121 has a horizontal level surface extending in the longitudinal direction of the machine and is fixed On the machine frame 104. The connection piece 19 is fitted on the conveyor 17 by means of a screw 113 and guided by the engagement of a guide projection 83 in a guide recess 84 of the guide rail 121 in the longitudinal direction of the machine. Guide grooves 101', 102' are formed above and below in the guide recess 84 for this purpose, in which the complementary bourrelets 98', 99' engage. The supporting arm 85 extends upwards, from which the connection piece finger 19' branches off upwards, in order to engage with the foot 13' in the connection piece. According to FIG. 5, the foot 13' touches a stop surface 19'', of the connecting piece 19 with a rear side extending in the conveying direction (arrow), whilst the side turned away from the connection piece finger 19' touches the curved guide surface of the support element 90 corresponding to the foot 13' so that the peg tray 18 is held resiliently to be detachable in a direction away from the conveyor belt 17.

The connection piece finger 19' which slides the peg tray 18 in the direction of the arrow in FIG. 5, determines the exact position of the peg tray 18. The curved guide surface of the support element 90 only serves the purpose of holding the peg 13 or the foot 13' of the peg 13 in position against the connection piece finger 19' and if necessary against the surface 19'', and to make a movement of the peg tray 18 vertically to the conveying direction impossible, in any case, for long enough until an appropriately strong frontal force has been exercised.

Figure 6:
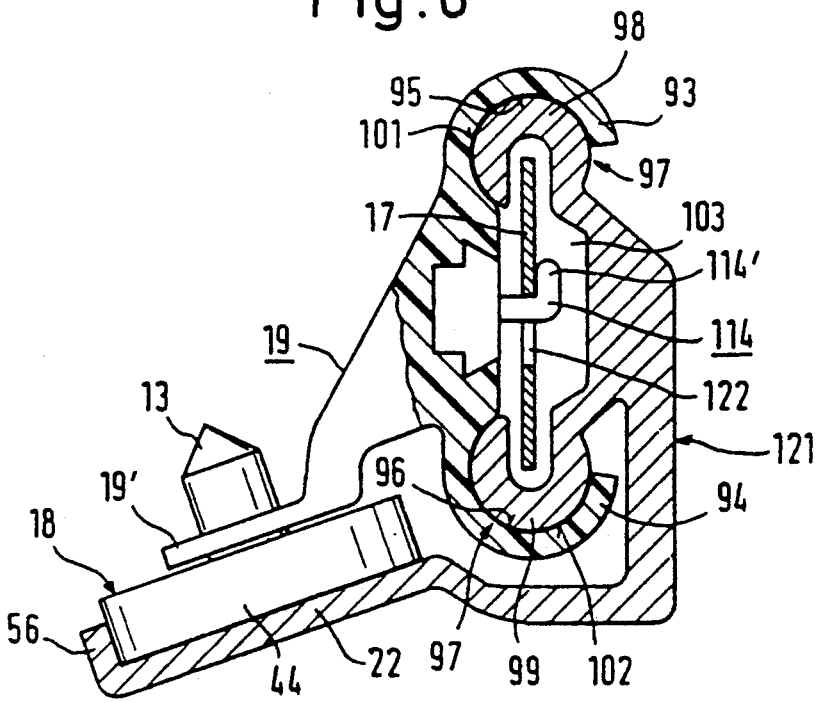
FIG. 6 illustrates a cross-sectional view of a further modified connecting piece and guide rail in accordance with the invention.

Referring to FIG. 6, wherein like reference characters indicate like parts as above, the carrier rail 22 may be provided with a lateral guide 56 disposed at an upward angle in order to avoid lateral slipping of a peg tray 18 from the carrier rail 22. In this case, the auxiliary support element 90 shown in FIG. 5 Can be eliminated.

As further shown in FIG. 6, the guide rail 121 has a recess 103 receiving the conveyor belt 17. In this respect, the conveyor 17 is spaced from the bourrelets 98, 99 so as not to make contact with the guide rail 121. In addition, each connecting piece 19 carries an integral anchor 114 of L-shaped construction so that a leg 114' may pass through a slot 122 in the conveyor belts 17 and engage against a rear surface of the conveyor belt 17 relative to the connecting piece 19. This construction permits the connecting piece to be readily assembled and disassembled from the conveyor belt 17.

The invention thus provides a relatively simple arrangement for conveying peg trays along a ring spinning machine.

What is claimed is:

1. In a ring spinning machine, the combination comprising a vertically disposed endless conveyor belt for moving along at least one row of spaced apart spinning stations;

a carrier rail extending along said row of spinning stations for slidably guiding peg trays thereon;

a guide rail secured to said carrier rail and having guide means on a vertical side thereof; and a plurality of connection pieces secured to said belt in spaced apart relation corresponding to the spaced relation of the spinning stations for moving the peg trays along said carrier rail, each said connection piece having a projecting finger for moving a respective peg tray along said carrier rail and guide means on a vertical side of said connecting piece in sliding engagement with said guide means on said guide rail.

2. The combination as set forth in claim 1 wherein said guide means on said guide rail includes a pair of vertically spaced projections and said guide means on each connection piece includes a pair of resilient vertically spaced tongues snap-fitted over said projections.

3. The combination as set forth in claim 2 wherein each projection is rounded and each tongue is curved to mate with a respective projection along a curved surface.

4. The combination as set forth in claim 1 wherein said guide means on said guide rail includes a recess and said guide means on each connection piece includes a projection received in said recess in sliding relation.

5. The combination a set forth in claim 1 wherein each connection piece is disposed between said belt and said guide rail.

6. The combination as set forth in claim 1 wherein said guide rail has a recess receiving said belt.

7. The combination as set forth in claim 6 wherein said guide means on said guide rail includes a pair of vertically spaced projections and said guide means on each connection piece includes a pair of resilient vertically spaced tongues snap-fitted over said projections.

8. The combination as set forth in claim 1 wherein said guide rail is disposed below said carrier rail.

9. The combination as set forth in claim 1 wherein each connection piece has a contact surface extending vertically over the height of said belt.

10. The combination as set forth in claim 1 wherein each connection piece further includes a resiliently mounted support element extending in parallel to said projecting finger thereof for resiliently grasping a peg tray therebetween.

11. The combination as set forth in claim 1 wherein said carrier rail is flat and is disposed on an angle of from 5° to 15° relative to a horizontal plane.

12. The combination as set forth in claim 11 wherein said carrier rail is inclined downwardly in a direction away from said belt.

13. The combination as set forth in claim 1 wherein said carrier rail and said guide rail are of integral one-piece construction.

14. The combination as set forth in claim 1 wherein said projecting finger has a part parallel to said carrier rail.

15. The combination as set forth in claim 14 wherein said carrier rail is flat and is disposed on an angle of from 5° to 15° relative to a horizontal plane.

16. The combination as set forth in claim 1 which further comprises a machine frame having a recess receiving said guide rail and a guide strip engaging over a projection of said guide rail; and a clamping strip secured to said machine frame over a front projection of said guide rail.

17. The combination as set forth in claim 1 wherein said belt is a flat steel belt.

18. The combination as set forth in claim 17 wherein each connecting piece is made of plastic.

19. The combination as set forth in claim 1 wherein said belt is disposed in a vertical plane passing through a central portion of said carrier rail.

20. The combination as set forth in claim 1 wherein each connecting piece is releasably secured to said belt.

* * * * *